US005343020A

United States Patent [19]

Waigand et al.

[11] Patent Number: 5,343,020

[45] Date of Patent: Aug. 30, 1994

[54] STOVE WITH A CAPACITIVE SAILING SENSOR AND SENSOR-CONTROLLED STARTING OF PYROLYSIS

[75] Inventors: Helmut Waigand, St. Georgen; Gottfried Wallner, Tengling, both of Fed. Rep. of Germany

[73] Assignee: Bosch-Siemens Hausgeraete GmbH, Munich, Fed. Rep. of Germany

[21] Appl. No.: 932,306

[22] Filed: Aug. 19, 1992

[30] Foreign Application Priority Data

Aug. 19, 1991 [DE] Fed. Rep. of Germany ..... 4127388

[51] Int. Cl.[5] ..... H05B 1/02

[52] U.S. Cl. ..... 219/413; 219/412; 324/661; 73/61.62

[58] Field of Search ..... 219/492, 494, 497, 501, 219/506, 413, 412, 414, 482, 505; 324/686, 661; 73/60.11, 61.62

[56] References Cited

U.S. PATENT DOCUMENTS 3,625,197 12/1971 Pirker et al. ..... 219/413
4,051,347 9/1977 Rohrl et al. ..... 219/413
4,954,694 9/1990 Nagai et al. ..... 219/413
5,040,724 8/1991 Brinkruff et al. ..... 219/501
5,083,010 1/1992 Henry et al. ..... 219/413

*Primary Examiner*—Mark H. Paschall
*Attorney, Agent, or Firm*—Herbert L. Lerner; Laurence A. Greenberg

[57] ABSTRACT

A stove with pyrolytic self-cleaning includes an oven having an oven space, at least one wall region, a heating element disposed in the at least one wall region, a forced-air blower for venting the oven, a device for pyrolytic self-cleaning, and an optional forced-air heating device. A sensor system is disposed in the oven space for detecting operationally dictated oven soiling values and issuing input values. An evaluation circuit has an input connected to the sensor system for frequency-converting the input values, for digitizing the input values, for counting the input values, for storing the input values, and for concatenating the input values. The evaluation circuit has an output side signaling a degree of soiling and the evaluation circuit recommends and/or carries out an initiation of pyrolysis.

13 Claims, 2 Drawing Sheets

STOVE WITH A CAPACITIVE SAILING SENSOR AND SENSOR-CONTROLLED STARTING OF PYROLYSIS

The invention relates to a stove with pyrolytic self-cleaning, having an oven, a heating element disposed in at least one wall region and an optional additional forced-air heater for operating the oven, a forced-air blower for venting the oven, and means for pyrolytic self-cleaning.

It is well known that soiling of an oven space beyond an acceptable extent can be prevented or eliminated with the aid of pyrolytic self-cleaning. Previously, the decision to initiate pyrolytic cleaning was largely left to the user, in other words a home maker, so that pyrolytic self-cleaning that was not justified objectively, was often done. As a consequence of such individual cleaning cycles performed by pyrolytic self-cleaning, not only is energy wasted, but the enamel coating of the oven also suffers.

It is accordingly an object of the invention to provide a stove with sensor-controlled starting of pyrolysis, which overcomes the hereinafore-mentioned disadvantages of the heretofore-known devices of this general type and which provides electronic means that objectively justify the pyrolytic cleaning operations.

With the foregoing and other objects in view there is provided, in accordance with the invention, a stove with pyrolytic self-cleaning, comprising an oven having an oven space, at least one wall region, a heating element disposed in the at least one wall region for operating the oven, an optional forced-air or recirculating heating device, a forced-air or recirculating blower for venting the oven, and means for pyrolytic self-cleaning, a sensor system disposed in the oven space for detecting operationally dictated oven soiling values and issuing input values; an evaluation circuit having an input connected to the sensor system for frequency-converting the input values, for digitizing the input values, for counting the input values, for storing the input values, and for concatenating the input values, the evaluation circuit having an output side signaling a degree of soiling, and the evaluation circuit recommends and/or carries out an initiation of pyrolysis.

As a result of the configuration according to the invention, the process of cleaning the oven box is controlled by a sensor system, which objectively evaluates the soiling in combination with an evaluation circuit.

In accordance with another feature of the invention, the sensor system includes a predominantly capacitively acting sensor.

In accordance with a further feature of the invention, the sensor system includes a sensor having at least two conductor tracks being insulated from one another, and an enameled metal chip on which the conductor tracks are disposed.

In accordance with an added feature of the invention, two of the sensor conductor tracks are U-shaped defining two U legs with an opening therebetween, and the sensor conductor tracks face each other with one leg of one sensor conductor track fitting into the opening of the other sensor conductor track.

In accordance with a concomitant feature of the invention, the at least one wall region includes a side wall region, and the sensor system includes a capacitive sensor disposed in the side wall region.

Other features which are considered as characteristic for the invention are set forth in the appended claims.

Although the invention is illustrated and described herein as embodied in a stove with sensor-controlled starting of pyrolysis, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
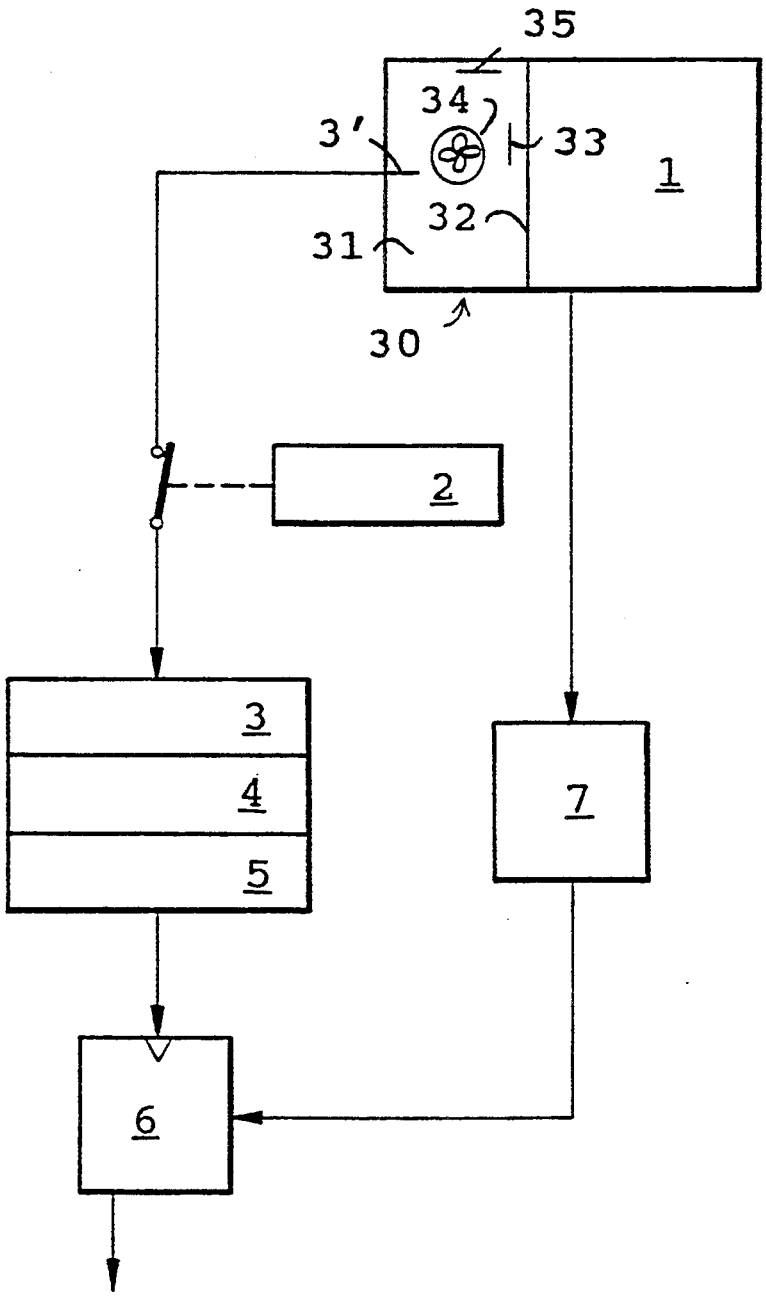
FIG. 1 is a block diagram of a circuit for the preparation of a sensor signal.

Referring now to the figures of the drawing in detail and first, particularly, to FIG. 1 thereof, there is seen a stove 1 with conventional oven operation, a stove 2 with solely microwave operation, a sensor 3, a stage 4 having an oscillator with a frequency converter connected to it, a digitizing stage 5, a JK flip-flop 6, and a clock generator 7.

The stove 1 has an oven 30 with an oven space 31 having oven walls which include a side wall region 32. A heating element 33 is disposed in the side wall region 32. A forced-air blower and/or heater 34 and a pyrolytic self-cleaning device 35 are disposed in the oven space 31. A probe 3' of a sensor system including the sensor 3 is also disposed in the oven space 31.

If the oven is operating with a conventional-oven mode turned on (without exclusive microwave operation), then the sensor 3 should be turned on and soiling values recorded by it should be evaluated. This soiling sensor includes an enameled metal chip with conductor tracks, which are preferably intertwined in the form of interlocking U's. If a change in capacitance of the sensor occurs in the course of oven operation, for instance from fat droplets or from other soiling values acting upon the metal tracks, this results in a change in frequency of the oscillator connected to the output side. On the input side, the sensor 3 acts upon the oscillator and frequency converter stage 4, and each change in frequency is converted into a change in voltage. The digitizing stage 5 connected to the output side enables technically simple counting of the frequency changes of the oscillator stage 4. These frequency change pulses are counted by the JK flip-flop 6, which is continuously reset by the clock generator 7, at a preset rate. It then becomes possible to store the duration of the frequency change in a pulse train corresponding to that duration in a processing logic system. The sensor thus furnishes a measure of the way in which, and for how long, an oven mode brings about soiling values, which remain in this stove as long as the stove is not cleaned. In addition to the change in capacitance of the sensor, the ohmic performance of the sensor conductor tracks also changes, since they undergo parallel short circuits of an ohmic nature as a consequence of special components of the soil. Other types of change in the electrical properties of the sensor can be utilized for a readily evaluatable frequency change of an oscillator.

Figure 2:
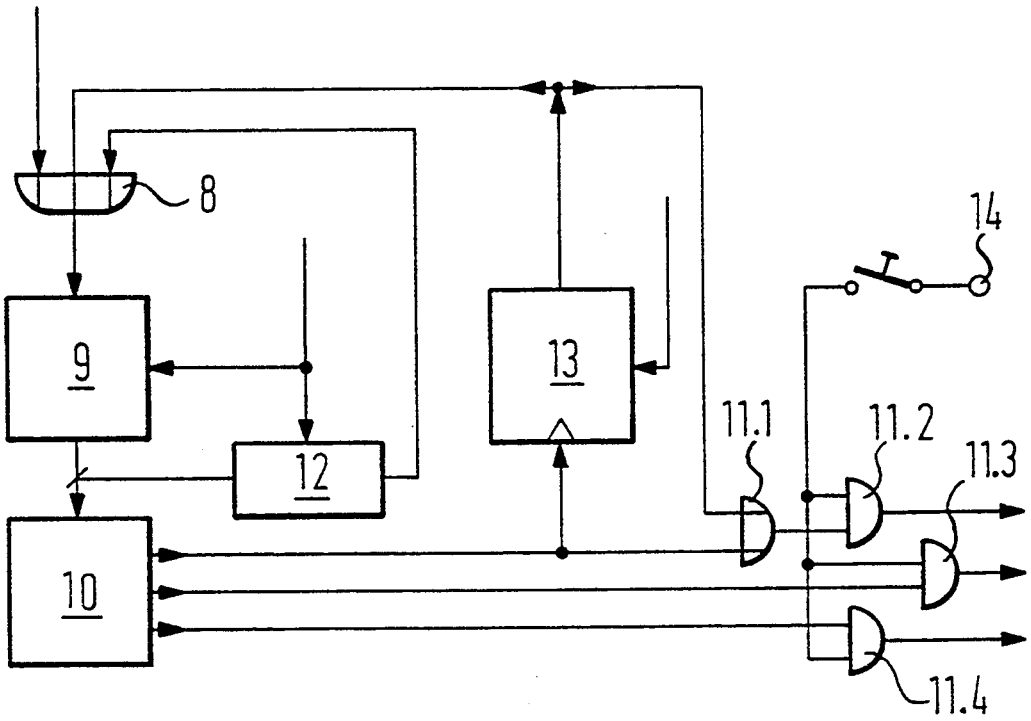
FIG. 2 is a schematic and block diagram of a circuit for the further processing of the prepared sensor signal.

FIG. 2 shows an OR element 8, a counter 9, a concatenation or linkage logic 10, a decoder logic 11.1, 11.2, 11.3 and 11.4, a memory 12, a JK flip-flop 13, and an inquiry key 14. Processed and prepared sensor signals pass from the JK flip-flop 6 through the OR element 8 to the counter 9, which counts the sensor signal trains. A resetting case for the counter 9 is attained if a self-cleaning operation is beginning. On the output side, the counter 9 is connected to the concatenation logic 10. The output of the counter 9 is also carried to the memory 12, which contains the current status of the counter 9 at any given time. Thus, if there is a power failure, the content of the memory 12, which cannot be affected by the power failure, can be read into the counter 9 at any time. Resetting of this memory is also performed upon a self-cleaning operation. The concatenation logic 10 supplies the decoder logic 11.1–11.4 and also returns a cluster of concatenation signals to the counter 9, through the JK flip-flop 13. With the aid of the inquiry key 14 and the decoder logic 11.1–11.4, the user of the stove can inquire about the degree of soiling of the oven. Moreover, it is possible to immediately signal heavy soiling or to automatically initiate pyrolytic self-cleaning, if the user of the stove wishes. Through the use of a display, the decoder logic furnishes the various degrees of soiling, from a clean stove to a heavily soiled one, after each inquiry.

Figure 3:
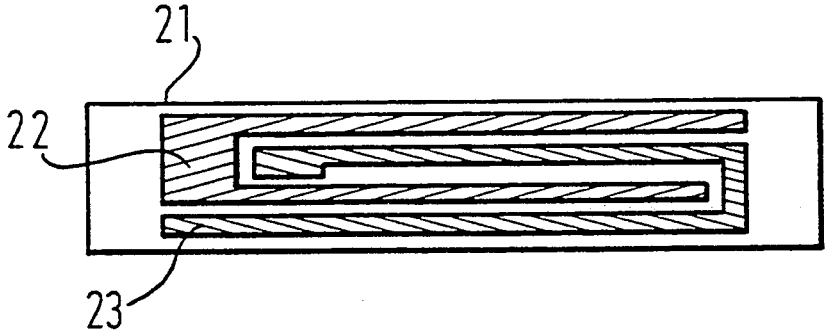
FIG. 3 is a sectional view of an embodiment of a soiling sensor.

In FIG. 3, a version of the soiling sensor that has a sheet-metal base 21 and conductor tracks 22 and 23 is shown. Demands made of the sensors, in particular electrical demands and structural demands, are determined by extreme conditions incident to pyrolysis. The sensor, which is disposed on an enameled, profiled sheet-metal strip unit, should be temperature-resistant up to 500° C., should have an oxidation-free conductor track, should be abrasion-free, and should suitably allow rearward-extending electrical bonding. The electrical demands are in particular that there must be high electrical junction resistances between the conductor tracks and between the conductor tracks and the sheet-metal base. These resistances may be on the order of magnitude of 5 megaohms. In contrast, the contact or touch resistance with respect to the conductor track should be quite low. In other words, the conductor tracks must not form any high-impedance oxide film. Another goal is to ensure that the conductor track has an electrical resistance that only insignificantly varies over the requisite temperature range. In terms of construction, one of the possible embodiments of the sensor is specified as being one in which the sensor includes at least two conductor tracks, which are disposed and insulated from one another, on an enameled metal chip. The two sensor conductor tracks are U-shaped and are disposed in such a way as to face one another with the leg of one U fitting into the open end of the U opposite it. Inside the oven box, the sensor is preferably disposed in a side wall region of the box. It is therefore a goal to select a special side wall which is specific to the particular oven box and is typical for soil, so that a total of only one sensor needs to be used for pyrolytic self-cleaning.

What is claimed is:

1. A stove with pyrolytic self-cleaning, comprising:

an oven having an oven space, at least one wall region, a heating element disposed in said at least one wall region, a forced-air blower for venting said oven, and means for pyrolytic self-cleaning;

a sensor system disposed in said oven space for detecting operationally dictated oven soiling values and issuing input values, said sensor system including a predominantly capacitively acting sensor having at least two conductor tracks being insulated from one another and an enameled metal chip on which said conductor tracks are disposed;

an evaluation circuit having an input connected to said sensor system for frequency-converting the input values, for digitizing the input values, for counting the input values, for storing the input values, and for concatenating the input values, and said evaluation circuit having an output side signaling a degree of soiling.

2. The stove with pyrolytic self-cleaning according to claim 1, wherein said oven has a forced-air heating device.

3. The stove with pyrolytic self-cleaning according to claim 1, wherein said evaluation circuit recommends an initiation of pyrolysis.

4. The stove with pyrolytic self-cleaning according to claim 1, wherein said evaluation circuit carries out an initiation of pyrolysis.

5. The stove with pyrolytic self-cleaning according to claim 1, wherein said evaluation circuit recommends and carries out an initiation of pyrolysis.

6. The stove with pyrolytic self-cleaning according to claim 1, wherein two of said sensor conductor tracks are U-shaped defining two U legs with an opening therebetween, and said sensor conductor tracks face each other with one leg of one sensor conductor track fitting into the opening of the other sensor conductor track.

7. The stove with pyrolytic self-cleaning according to claim 1, wherein said at least one wall region includes a side wall region, and said sensor system includes a capacitive sensor disposed in said side wall region.

8. A stove with pyrolytic self-cleaning, comprising:

an oven having an oven space;

a sensor system disposed in said oven space for detecting operationally dictated oven soiling values and issuing input values, said sensor system including a predominantly capacitively acting sensor with at least two conductor tracks being insulated from one another and an enameled metal chip on which said conductor tracks are disposed;

an evaluation circuit having an input connected to said sensor system for frequency-converting the input values, for digitizing the input values, for counting the input values, for storing the input values, and for concatenating the input values, and said evaluation circuit having an output side signaling a degree of soiling.

9. The stove with pyrolytic self-cleaning according to claim 8, wherein said evaluation circuit recommends an initiation of pyrolysis.

10. The stove with pyrolytic self-cleaning according to claim 8, wherein said evaluation circuit carries out an initiation of pyrolysis.

11. The stove with pyrolytic self-cleaning according to claim 8, wherein said evaluation circuit recommends and carries out an initiation of pyrolysis.

12. The stove with pyrolytic self-cleaning according to claim 8, wherein two of said sensor conductor tracks are U-shaped defining two U legs with an opening therebetween, and said sensor conductor tracks face each other with one leg of one sensor conductor track fitting into the opening of the other sensor conductor track.

13. The stove with pyrolytic self-cleaning according to claim 8, wherein said at least one wall region includes a side wall region, and said sensor system includes a capacitive sensor disposed in said side wall region.

* * * * *